US008292031B2

(12) United States Patent
Penn et al.

(10) Patent No.: US 8,292,031 B2
(45) **Date of Patent: *Oct. 23, 2012**

(54) PLATFORM LIFT APPARATUS FOR ATTIC STORAGE SPACE

(75) Inventors: Jay P. Penn, Redondo Beach, CA (US); George Kaszas, Redondo Beach, CA (US); Brian M. Berliner, Palos Verdes Estates, CA (US)

(73) Assignee: Spacelift Products Inc., Redondo Beach, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/190,972

(22) Filed: Aug. 13, 2008

(65) Prior Publication Data

US 2008/0296089 A1 Dec. 4, 2008

Related U.S. Application Data

(63) Continuation of application No. 10/759,500, filed on Jan. 16, 2004, now Pat. No. 7,416,055.

(60) Provisional application No. 60/501,235, filed on Sep. 8, 2003, provisional application No. 60/526,568, filed on Dec. 2, 2003.

(51) Int. Cl.
*E04G 3/00* (2006.01)

(52) U.S. Cl. ..... 182/141; 182/142; 182/143; 182/144; 182/145; 182/146; 182/150; 187/253; 187/259

(58) Field of Classification Search ..... 182/141–146, 182/50; 187/259, 253
See application file for complete search history.

(56) References Cited

U.S. PATENT DOCUMENTS

| | | | | |
|---|---|---|---|---|
| 524,344 | A | 8/1894 | Brunkhorst et al. | |
| 778,259 | A | 12/1904 | Milne | |
| 1,164,143 | A | 12/1915 | Swift | |
| 1,270,716 | A * | 6/1918 | Flannery | 187/259 |
| 1,338,127 | A | 4/1920 | Felt | |
| 1,348,138 | A | 7/1920 | Hunt | |
| 1,484,389 | A | 2/1924 | Folkers | |
| 1,938,658 | A | 12/1933 | Harnischfeger | |
| 2,242,892 | A | 5/1941 | Light | |
| RE22,069 | E | 4/1942 | Medenwald | |
| 2,499,791 | A * | 3/1950 | Spencer | 312/247 |
| 2,643,662 | A | 6/1953 | Bunce | |
| 2,869,908 | A * | 1/1959 | Ford | 292/1 |
| 3,341,034 | A | 9/1967 | Blasen | |
| 3,565,217 | A | 2/1971 | Louis | |
| 3,957,137 | A | 5/1976 | Vermette | |
| 3,985,202 | A | 10/1976 | Harmon | |
| 4,172,686 | A * | 10/1979 | Shorthouse | 414/796.2 |

(Continued)

*Primary Examiner* — Alvin Chin Shue
*Assistant Examiner* — Colleen M Chavchavadze
(74) *Attorney, Agent, or Firm* — O'Melveny & Myers LLP

(57) ABSTRACT

A platform lift apparatus enables the safe movement of objects to and from an attic storage space. The platform lift apparatus includes a frame, a drive mechanism, and a platform. The frame includes internal and external mounting surfaces. The drive mechanism is substantially disposed within the frame and is coupled to the internal mounting surfaces. The drive mechanism includes a plurality of rotatable, parallel shafts with each shaft further including at least one lift drum having an associated lift tether at least partially wound thereon and having an end hanging therefrom. The platform is coupled to each lift tether end and is thereby suspended from the frame. The platform is selectively movable by operation of the drive mechanism within in a vertical dimension between raised and lowered positions. The drive mechanism further comprises an electric motor operatively coupled to the plurality of parallel shafts.

5 Claims, 13 Drawing Sheets

U.S. PATENT DOCUMENTS

| | | | | | |
|---|---|---|---|---|---|
| 4,252,217 | A | | 2/1981 | Benjamin | |
| 4,252,491 | A | | 2/1981 | Hock | |
| 4,412,601 | A | * | 11/1983 | Cooper | 312/242 |
| 4,541,508 | A | | 9/1985 | Lundh | |
| 4,650,036 | A | | 3/1987 | Matsuda | |
| 4,773,507 | A | * | 9/1988 | Kratz | 187/256 |
| 4,781,510 | A | | 11/1988 | Smith et al. | |
| 4,867,627 | A | * | 9/1989 | Tseng | 414/249 |
| 5,050,706 | A | | 9/1991 | Cole et al. | |
| 5,111,906 | A | | 5/1992 | Abadia | |
| 5,205,379 | A | | 4/1993 | Pfleger | |
| 5,207,297 | A | * | 5/1993 | Beattie et al. | 187/208 |
| 5,239,795 | A | | 8/1993 | Breaux | |
| 5,366,203 | A | * | 11/1994 | Huffman | 254/362 |
| 5,535,852 | A | | 7/1996 | Bishop et al. | |
| 5,667,035 | A | | 9/1997 | Hughes | |
| 5,845,745 | A | | 12/1998 | Lane | |
| 5,871,069 | A | | 2/1999 | Carmitchel | |
| 5,893,431 | A | | 4/1999 | Cranswick et al. | |
| 6,095,344 | A | | 8/2000 | White | |
| 6,131,702 | A | | 10/2000 | Berridge | |
| 6,516,570 | B2 | | 2/2003 | Liebetrau et al. | |
| 6,991,064 | B2 | | 1/2006 | Ehrenleitner | |
| 7,234,685 | B2 | * | 6/2007 | Britten | 254/385 |
| 7,523,919 | B2 | * | 4/2009 | Hanlon | 254/278 |
| 2007/0114098 | A1 | * | 5/2007 | Hartley | 187/259 |

* cited by examiner

PLATFORM LIFT APPARATUS FOR ATTIC STORAGE SPACE

RELATED APPLICATION DATA

This patent application is a continuation of U.S. patent application Ser. No. 10/759,500, filed Jan. 16, 2004, now issued as U.S. Pat. No. 7,416,055 on Aug. 26, 2008. This patent application also claims priority pursuant to 35 U.S.C. 119(c) to U.S. Provisional Application Ser. Nos. 60/501,235 filed Sep. 8, 2003, and 60/526,568 filed Dec. 2, 2003.

BACKGROUND OF THE INVENTION

1. Field of the Invention

The present invention relates to residential or commercial storage, or more particularly, to a platform lift apparatus for raising or lowering objects into an upper storage location such as an attic storage space located above a garage or living quarters.

2. Description of Related Art

Many homes have attic spaces above garages and living quarters, and these attic spaces often provide a storage location for various items. While some attic spaces are finished and have access via a stairwell, most attic spaces remain unfinished and have more rudimentary access systems. The most basic access system is a simple opening or scuttle hole formed in the ceiling dividing the attic space from the room below. The scuttle hole is commonly located in a closet or main hallway, and may be covered by a hatch that comprises a removable portion of ceiling, such as formed from plywood or drywall. A user would position a ladder below the opening and access the storage space by carrying storage objects up and down the ladder. An improvement over this basic access system is a pull-down ladder that is built into a hingedly attached door covering the opening. The pull-down ladder may be folded into a plurality of sections to provide a compact structure when stowed. The user opens the door and unfolds the ladder to bring it into an operational position. This pull-down ladder has improved convenience since the user does not have to transport a ladder to and from the access location, and the ladder is anchored to the opening to thereby provide an increased degree of safety for the user.

Nevertheless, a drawback of each of these access systems is that it is difficult to transport objects up and down the ladder. The user cannot easily carry the object and grasp the ladder at the same time, thereby forcing a dangerous tradeoff between carrying capacity and safety. Moreover, the size and weight of the objects that may be transported is limited to that which could be manually carried and fit through the dimensions of the access opening. Users of such access systems have a substantial risk of injury due to falling and/or dropping objects, and the objects themselves can be damaged as well.

Thus, it would be advantageous to provide an improved way to transport objects to and from an attic storage space without the drawbacks and safety risks of the known access systems. Additionally, there are many other applications in which it would be desirable to transport objects to and from a raised position.

SUMMARY OF THE INVENTION

The present invention overcomes the foregoing drawbacks of the prior art by providing a platform lift apparatus usable to safely move objects to and from an attic storage space. The platform lift apparatus includes three main components: a frame, a drive mechanism, and a platform.

More particularly, the frame has internal and external mounting surfaces, and is adapted to be mounted into a scuttle hole separating an attic space from a room below. The drive mechanism is substantially disposed within the frame and is coupled to the internal mounting surfaces. The drive mechanism includes a plurality of rotatable, parallel shafts with each shaft further including at least one lift drum having an associated lift tether at least partially wound thereon and having an end hanging therefrom. The platform is coupled to the ends of the lift tethers and is thereby suspended from the frame. The platform is selectively movable by operation of the drive mechanism within in a vertical dimension between raised and lowered positions. The drive mechanism further comprises an electric motor operatively coupled to the plurality of parallel shafts.

In an embodiment of the invention, the plurality of parallel shafts further comprises two parallel shafts. The drive mechanism drives the parallel shafts to rotation in a like rotational direction. Each one of the shafts further comprises at least one drive pulley. The drive mechanism further comprises a drive belt coupled to respective drive pulleys of each of the parallel shafts, such that the shafts are driven to synchronous rotation by operation of the drive mechanism. The drive mechanism may further include at least one idler pulley in association with the lift drum that outwardly shifts a horizontal position of the lift tether.

In another embodiment of the invention, the platform further comprises a horizontal base and a plurality of vertical walls defining a basket. The platform may further include a foldable fence connected to the vertical walls. The lift tether ends may further include a releasable fastener coupled to a corresponding member on the platform, thereby enabling the platform to be disconnected from the lift apparatus, such as to facilitate loading. The platform may further include a seal providing a barrier between the platform and the frame when the platform is at the raised position.

In another embodiment of the invention, the drive mechanism further comprises at least one tensioner associated with each lift drum. The tensioner is disposed in contact with the lift tether associated with the lift drum to prevent twisting or kinking of the lift tether while winding on or unwinding from the lift drum. The tensioner further comprises a contact member and a spring biasing the contact member into contact with the lift tether. The contact member may further include a roller in contact with the lift tether.

In another embodiment of the invention, the plurality of parallel shafts further comprise two parallel shafts offset vertically with respect to each other. The drive mechanism drives the parallel shafts to rotation in opposite rotational directions. The lift tether associated with the lift drum on one of the shafts may be further coupled to a drive pulley of another one of the shafts. Alternatively, the lift drum of one of the plurality of parallel shafts may be further coupled to a corresponding lift drum of another one of the parallel shafts by the lift tether. This way, the plurality of shafts are driven to synchronous rotation in opposite directions by operation of the drive mechanism.

In another embodiment of the invention, an impact detection system is coupled to an underside of the platform for detecting impact of the platform upon an object. The impact detection system may include a contact plate and a plurality of springs coupling the contact plate to an underside of the platform. The contact plate is thereby moveable vertically against bias applied by the plurality of springs. A plurality of microswitches may be associated respectively with the plurality of springs. Each one of the microswitches is adapted to close and provide a corresponding signal upon compression of an associated one of the plurality of springs.

In another embodiment of the invention, a retractable wheel is coupled to an underside of the platform. The wheel permits the platform to be used as a dolly to facilitate movement of objects to and from the platform lift system.

A more complete understanding of the platform lift system will be afforded to those skilled in the art, as well as a realization of additional advantages and objects thereof, by a consideration of the following detailed description of the preferred embodiment. Reference will be made to the appended sheets of drawings, which will first be described briefly.

DETAILED DESCRIPTION OF PREFERRED EMBODIMENTS OF THE INVENTION

The present invention satisfies the need for an improved way to transport objects to and from an attic storage space without the drawbacks and safety risks of the known access systems. In the detailed description that follows, like element numerals are used to describe like elements illustrated in one or more figures.

More particularly, the invention provides a platform lift system that enables objects to be moved vertically between an attic space and a room below. The platform lift system includes a frame that is mounted into a scuttle hole formed in a horizontal supporting surface (i.e., attic floor or room ceiling) and a platform that is supported by the frame. The platform may be selectively raised or lowered in order to transport objects to/from the attic space. When in a raised position, the platform engages the frame and seals the attic space to provide a thermal barrier. Objects may be loaded onto or removed from the platform through the frame from within the attic space. The frame lies substantially flush with the ceiling floor, so as to maximize available storage space within the attic ceiling and minimize interference between the lift system and objects moved on and off the platform. The frame further includes a drive system that controls the movement of a plurality of tethers that are coupled to the platform. The platform is raised by withdrawing the tethers, and is lowered by paying out the tethers. It should be understood that the present patent application uses the term "attic" to broadly refer to a room or space disposed above a garage or living quarters of a house. While in most cases the attic comprises an uppermost space of the house located immediately below a roof, it should be appreciated that other raised spaces of a house, such as a loft, crawlspace, deck, balcony or patio, could also fall within a broad meaning of an attic as used in the present patent application.

Figure 1:
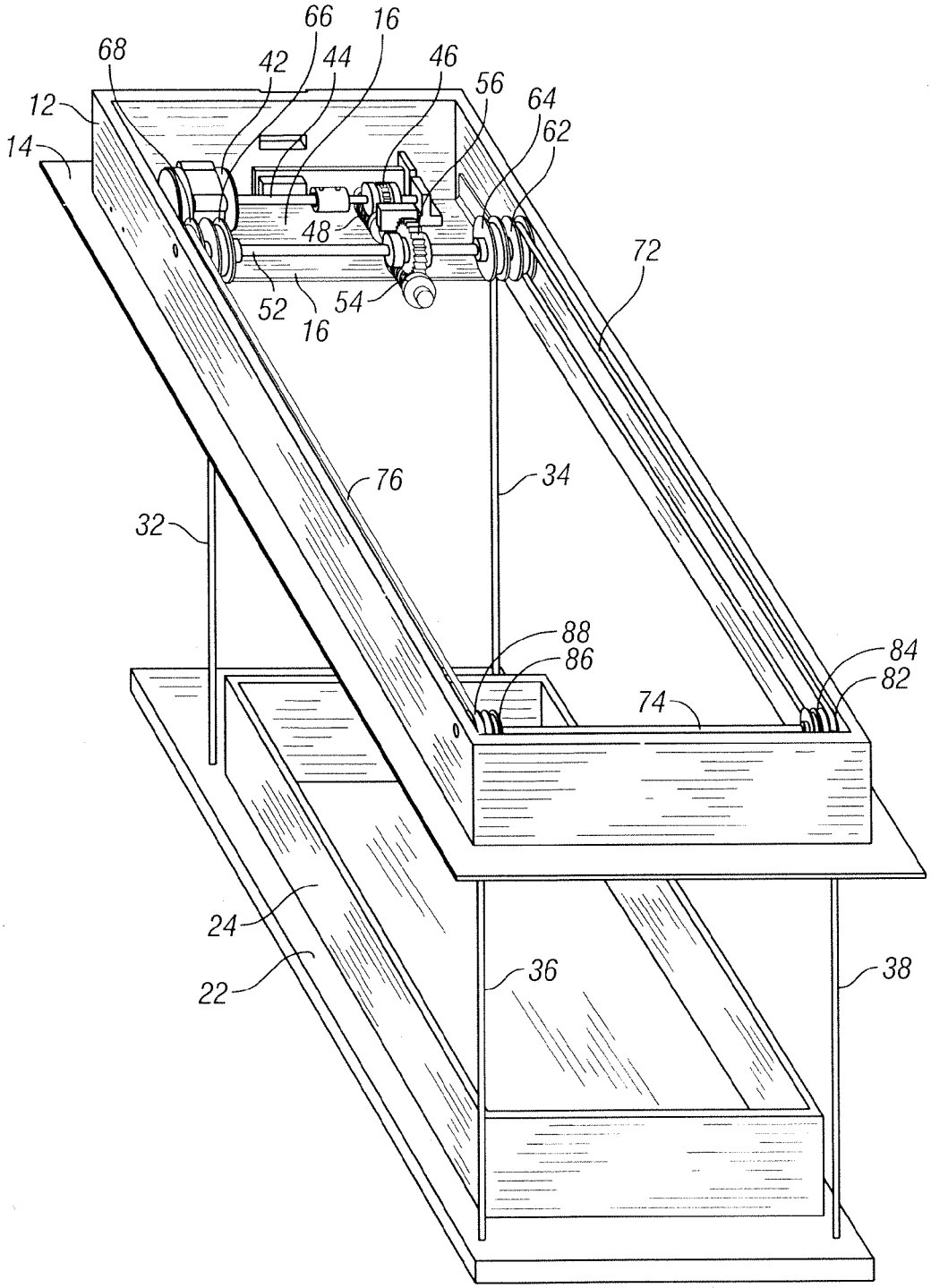
FIG. 1 is an isometric view of a platform lift system in accordance with an embodiment of the invention.

Referring first to FIG. 1, an exemplary platform lift system is shown in accordance with an embodiment of the invention. The platform lift system includes a frame 12 formed from four planar segments joined at respective ends to define a generally rectangular interior space. The frame segments may be comprised of any suitable material, such as wood, plastic, metal or other high strength, lightweight material capable of supporting a suitable load carried by the platform lift system. The frame 12 provides a mechanical structure that supports the other functional components of the platform lift system and provides a surface for mounting the platform lift system into a scuttle hole of an attic space (as will be further described below). The frame 12 may further include a lip 14 that provides a seal with the scuttle hole. The lip 14 may also provide a decorative border framing the scuttle hole.

The frame 12 carries a drive system (described below) that raises and lowers a platform by operation of lift tethers 32, 34, 36, 38. The platform comprises a horizontal base 22 having a generally rectangular shape with ends of the lift tethers 32, 34, 36, 38 joined to the base 22 at adjacent corners thereof. The platform may further comprise a vertically oriented wall 24 extending upward from the base and arranged in a rectangular shape to enclose a carrying space. The wall 24 provides a barrier to prevent objects from falling off the platform as it is raised and lowered. It is anticipated that the barrier function could be adequately achieved with the wall 24 extending upward by only a small distance (e.g., less than two inches), although other shapes and dimensions for the wall 24 could also be advantageously utilized. When the platform is fully raised upward, the wall 24 nests within the space defined by the frame 12 and the base 22 engages the frame 12 generally flush with the lip 14.

An exemplary drive system includes two shafts 52 and 74 that are rotatably mounted to the frame 12. The shafts 52, 74 are disposed in parallel with each other, and oriented horizontally with respect to the frame 12 and platform. Shaft 52 is disposed adjacent to a first end of the frame 12 and shaft 74 is disposed adjacent to a second end of the frame. The frame 12 may further include a collet and/or bearing assembly associated with each end of the shafts 52, 74 to engage the shaft end and thereby reduce rotational friction of the shafts.

Shafts 52, 74 each carry a drive pulley and a lift drum disposed alongside each other at both ends of each shaft. More specifically, shaft 52 carries drive pulley 62 and lift drum 64 disposed alongside each other at a first end thereof and lift drum 66 and drive pulley 68 disposed alongside each other at a second end thereof. Likewise, shaft 74 carries drive pulley 82 and lift drum 84 disposed alongside each other at a first end thereof and lift drum 86 and drive pulley 88 disposed alongside each other at a second end thereof. As shown in the figures, the drive pulleys are disposed peripherally outward along the shafts 52, 74 adjacent to the frame 12. It should be appreciated that alternative arrangement of the drive pulleys and lift drums could also be advantageously utilized. Drive pulleys 62 and 82 are aligned with each other and coupled by drive belt 72, and drive pulleys 68, 88 are similarly aligned and coupled by drive belt 76. Drive belts 72, 76 provide a continuous loop that moves in concert with the drive pulleys 62, 82, 68, 88. This way, the two shafts 52, 74 rotate in unison together.

It should be appreciated that the shaft 74 does not necessarily have to be a contiguous length, but rather could be formed of two shaft segments, with each segment carrying a respective drive pulley and lift drum. The shaft segments would each be supported by suitable brackets and collets that permit them to rotate in unison with the shaft 52.

The lift drums 64, 66, 84, 86 are coupled to respective lift tethers 34, 32, 38, 36. A first end of each lift tether is fixedly attached to a respective lift drum and the tether is thereby wound onto the drum. As described above, a second end of the lift tether hangs vertically from the pulley and is attached to the platform. The lift tethers may be comprised of any relatively flexible material that is capable of winding about a drum or spool and of being fastened at both ends. For example, the lift tethers may be comprised of a braided cord, band or webbing of nylon fibers or like materials providing high strength with minimal stretch and light weight. Other suitable materials may include rubber, plastic, metal cables or linked chains. The lift drums would be selected having a shape adapted to match the specific type of lift tether material selected. By way of example, if a cable material were selected for the lift tether, then a grooved lift drum would be employed to guide the cable upon retraction so that the cable does not overlap upon itself. Such selection of lift tether and lift drum is considered within the ordinary level of skill in the art.

In this embodiment as well as all other embodiments of the present invention, it should be appreciated that the drive belts may further include mating teeth at an inner surface thereof, and the drive pulleys may further comprise sprockets, cogs or gears that engage the teeth to maintain synchronized rotation of the shafts and thereby eliminate slippage between belt and pulley. The term "drive pulley" is therefore intended to broadly encompass any mechanical member coupled to an associated shaft for guiding or translating between axially rotational and linear movement, and the term "drive belt" is intended to encompass any type of elongated flexible material, such as cloth webbing, leather, artificial and natural fiber, metal (e.g., chain or cable), and the like, used to transmit motion under control of one or more "drive pulleys." By way of example, the drive belts may be formed of the same material as the lift tethers.

Motor 42 is mounted to the frame 12 using suitable brackets and is adapted to drive the shafts 52, 74 through suitable mechanical interconnection. Particularly, motor 42 drives shaft 44, which in turn drives a helical gear 46 that is in mesh with helical gear 48 affixed to a worm shaft oriented 900 to the motor shaft. The worm shaft carries worm 54 that is arranged in mesh with the shaft drive worm gear 56 coupled to shaft 52. The shaft 52 drives the lift drums that raise and lower the lift tethers. It should be appreciated that a wide variety of gear train arrangements can be selected to achieve a desired gear reduction ratio (e.g., 30:1) combined with optimal packaging efficiency. Similar gear ratios and packaging efficiencies can be achieved by use of one or more of the following approaches: conventional gear trains, planetary gearing, and harmonic/cyclic gearing. The required gear ratio could also be reduced by selection of a lower speed, higher torque motor. In another embodiment, the motor output torque could be selected to match the torque requirements by driving the shaft 52 directly (i.e., without a gear train). The motor 42 could then be mounted centrally on the shaft 52, with the motor shaft extending from both ends of the motor. The drive pulleys and lift drums could then be mounted onto opposite ends of the shaft.

Accordingly, motor 42 drives shaft 52 to rotation, and shaft 74 is driven to rotation in unison with shaft 52 by cooperation of the aforementioned drive pulleys and drive belts. When motor 42 is driven to rotation in a first direction, shafts 52, 74 will each be driven to rotation in a corresponding direction to unwind the lift tethers from the respective lift drums and thereby lower the platform. Conversely, when motor 42 is driven to rotation in a second (opposite) direction, shafts 52, 74 will each be driven to rotation in a corresponding direction to rewind the lift tethers onto the lift drums and thereby raise the platform. In a preferred embodiment of the invention, the shafts 52, 74 are keyed to match associated keying of the drive pulleys, lift drums, and shaft drive gear 56 so as to maintain synchronized movement of the shafts.

It will be appreciated that the platform lift system will include suitable control circuitry for activating the motor 42 in forward and reverse directions. The control circuitry may further include certain protective and safety features. For example, the control circuitry may be adapted to detect excess force (i.e., weight) and/or current draw, detection of blockage of the travel path via interruption of a light beam, and/or mechanical or electronic counter to determine if either the full travel distance has been accomplished and/or the rotational speed of the motor falls below a specified limit.

Although the frame 12 is illustrated as having a fixed rectangular shape, it should be appreciated that the frame may be adjustable to achieve different widths and/or lengths. For example, the shafts 52, 74 may be provided with adjustable length, such as using telescoping shaft segments that are fixed in position by tightening a set screw. The platform may also include a locking mechanism or pawl that locks the platform in the fully raised position. The locking mechanism may be disengaged automatically, such as using a solenoid, when it is desired to lower the platform.

Figure 2:
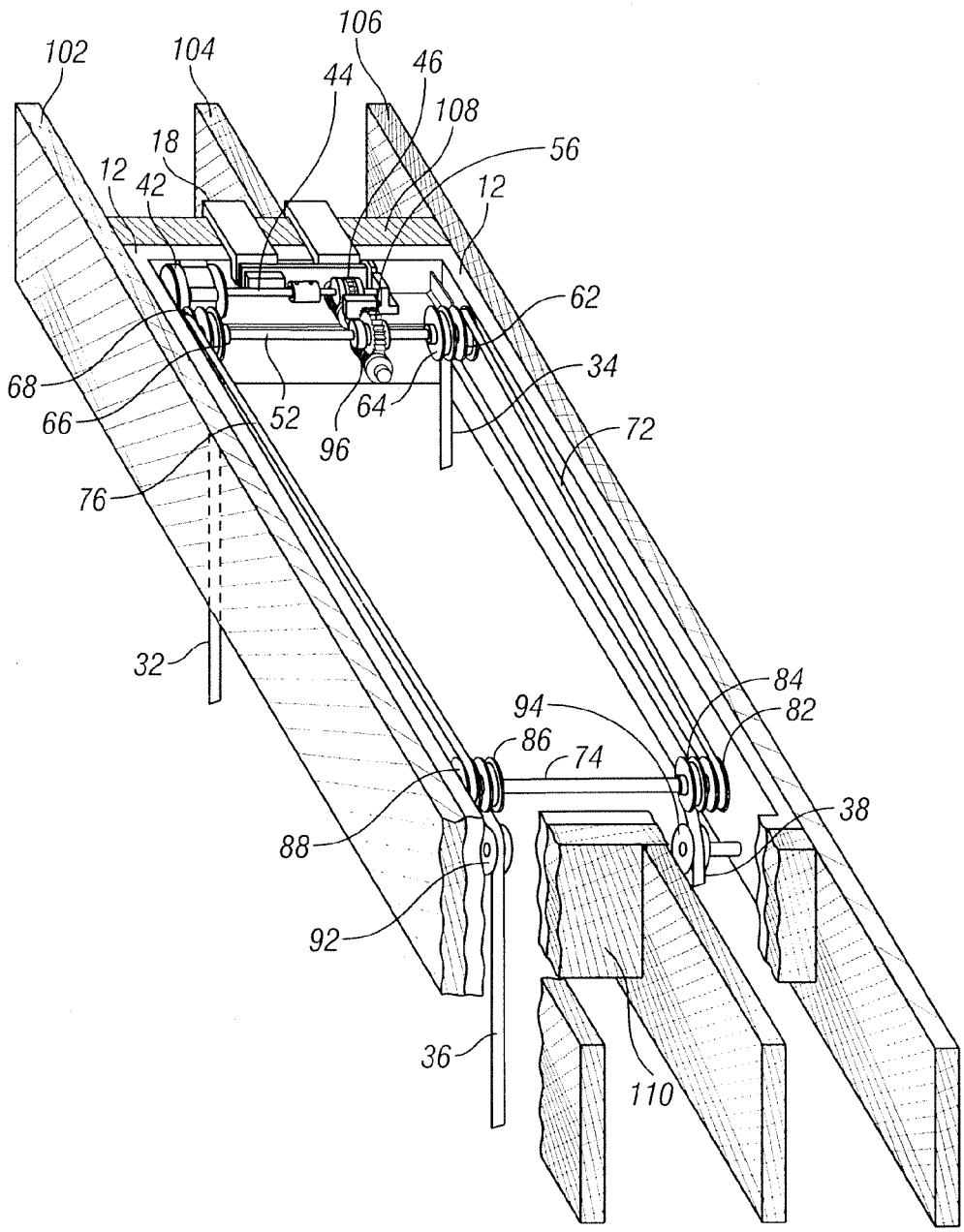
FIG. 2 is a partial sectional isometric view of a platform lift system installed between joists of an attic space in accordance with an embodiment of the invention.
Figure 3:
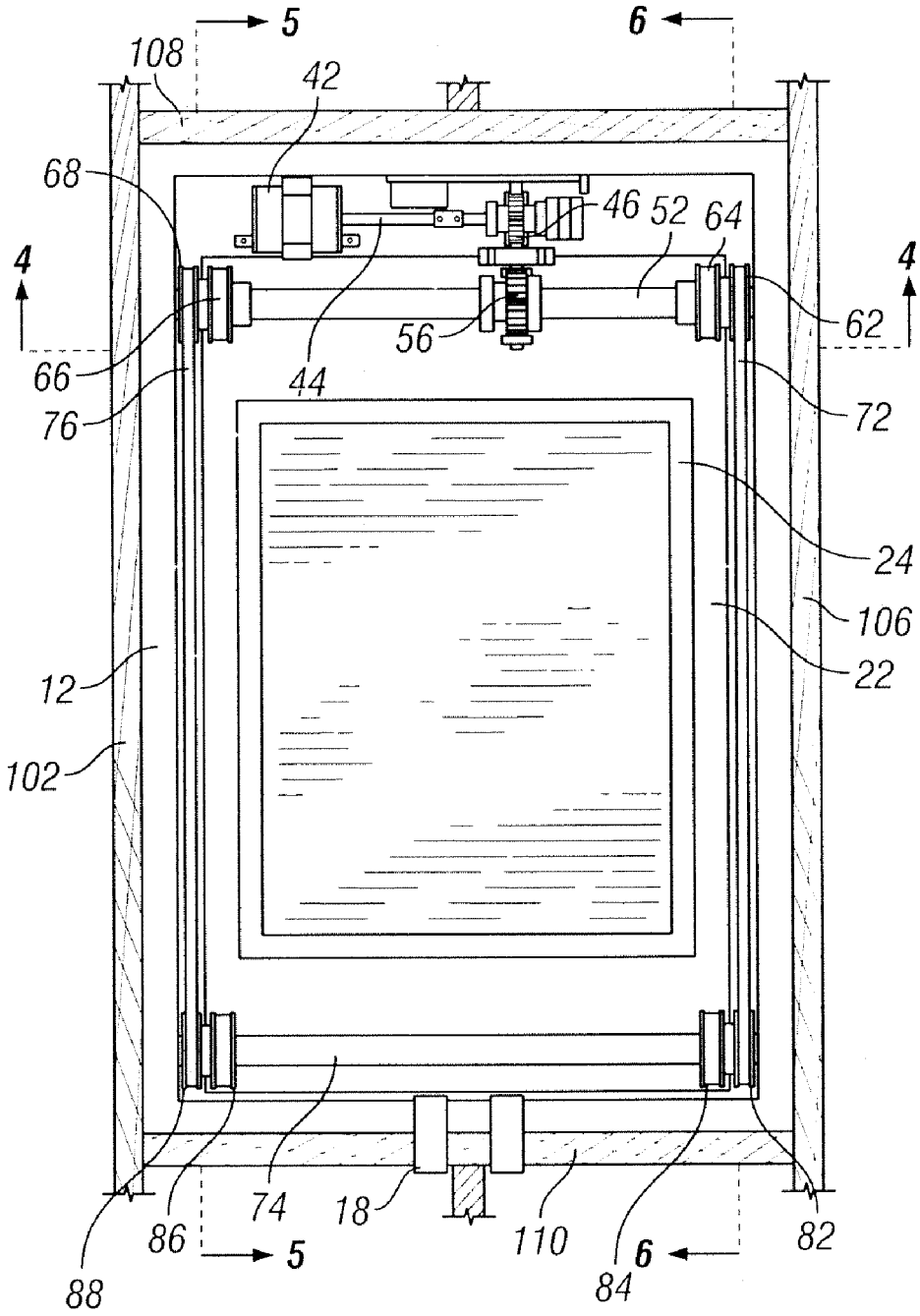
FIG. 3 is a top view of the platform lift system of FIG. 2.
Figure 4:
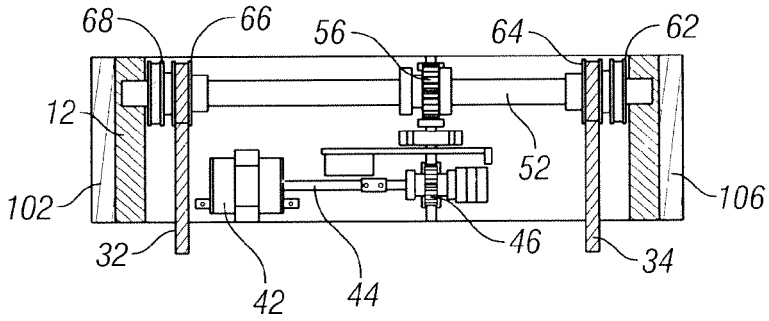
FIG. 4 is a sectional side view of the platform lift system as taken through the section 4-4 of FIG. 3.
Figure 5:
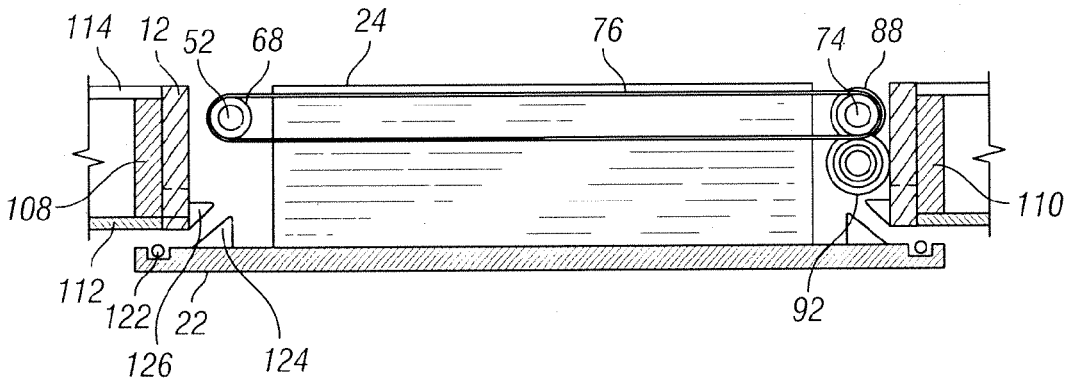
FIG. 5 is a sectional side view of the platform lift system as taken through the section 5-5 of FIG. 3.
Figure 6:
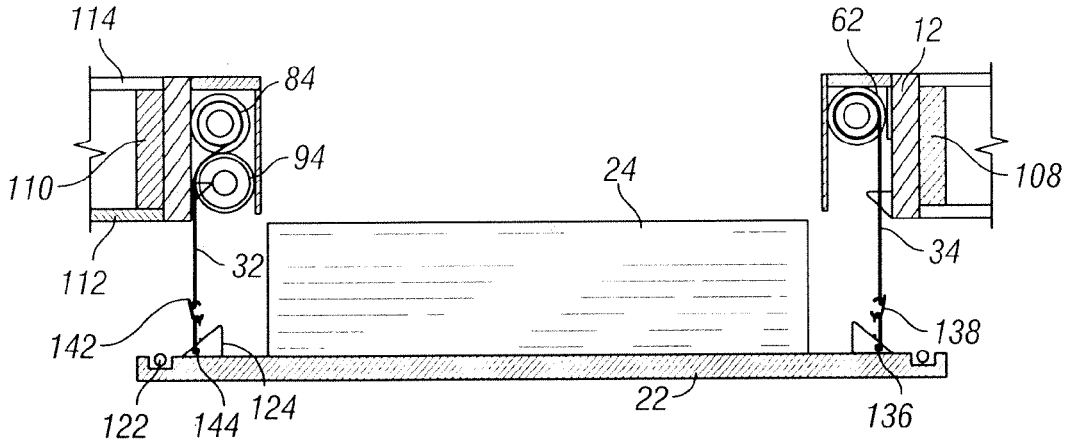
FIG. 6 is a sectional side view of the platform lift system as taken through the section 6-6 of FIG. 3.

FIG. 2 illustrates an isometric view of an embodiment of the platform lift system installed in a ceiling structure that is supported by horizontally extending joists 102, 104, 106. Likewise, FIG. 3 illustrates a top view of an embodiment of the platform lift system and associated platform, and FIGS. 4, 5 and 6 illustrate sectional views of the platform lift system as taken through the sections 4-4, 5-5, and 6-6 of FIG. 3, respectively. A rectangular scuttle hole is formed within the ceiling structure that is bounded on two sides by joists 102, 106 and on the other sides by crosspieces 108, 110 that abut the joists. As shown in FIG. 2, a section of an intermediary joist is removed for the length of the scuttle hole, such that the width of the scuttle hole corresponds to twice the separation between adjacent joists plus the width of one joist. A plurality of brackets, such as bracket 18, provides a rigid structural connection between the frame 12 and the joists and crosspieces. As will be understood to persons skilled in the art, the platform lift system maintains the structural integrity of the ceiling notwithstanding the removal of a section of joist. The platform lift system of FIG. 2 is substantially similar to that described above with respect to FIG. 1.

The embodiment of FIG. 2 further includes extension idlers 92, 94 that serve to move the respective lift tethers 36, 38 outward toward the peripheral region adjacent to the frame 12. The extension idlers 92, 94 are disposed below the lift drums 84, 86, respectively (also shown in FIGS. 5 and 6). The lift tethers 36, 38 pass from the lift drums 84, 86 to the extension idlers 92, 94 such that the lift drums and extension idlers are caused to rotate in opposite directions.

As shown in FIGS. 5 and 6, the base 22 may further include a seal 122 disposed on an upper surface therefore adjacent to an outer periphery of the base so as to form a thermal barrier and also to cushion the engagement of the platform with the frame 12 when the platform is in the fully raised position. The frame 12 and the base 22 may further be provided with respective guide ramps 126, 124 that facilitate the engagement of the platform with the frame as the platform is raised to the fully upward and stowed position.

FIG. 6 also shows the engagement between two of the lift tethers 32, 34 and the platform base 22. In a preferred embodiment of the invention, the ends of the lift tethers are provided with a fastening device 138, 142, such as a quick release fastener or buckle, which engages a corresponding receptacle 136, 144 coupled to the platform base 22. This permits the platform to be disconnected from the lift tethers, such as to facilitate loading of objects onto the platform. Moreover, the lengths of the lift tethers may be adjustable to fit the specific floor-to-ceiling height for a particular room application. It should be appreciated that a permanent connection between the platform and the lift tethers could also be advantageously utilized.

Figure 7:
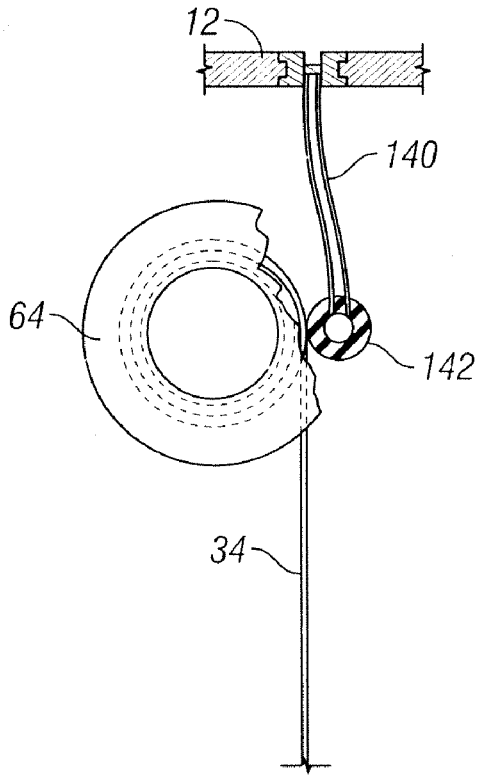
FIG. 7 is a side view of a lift drum having a tensioner.
Figure 8:
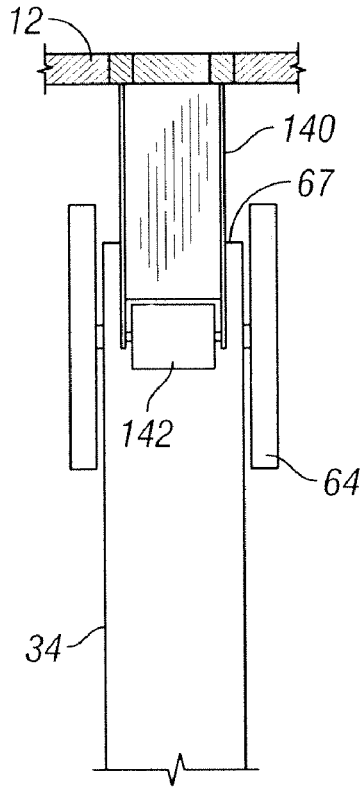
FIG. 8 is a front view of the tensioner and lift drum of FIG. 7.

FIGS. 7 and 8 illustrate an embodiment in which the lift drums (e.g., drum 64) are further provided with a tensioner. More particularly, the tensioner includes a tension spring 140 mounted to a portion of the frame 12. The tension spring 140 may be formed of a flexible band, such as a leaf spring. The tension spring 140 further includes a tension roller 142 coupled to an end of the spring. The tension spring biases the roller 142 into physical engagement with the lift tether 34 as it winds onto and unwinds from the lift drum 62, thereby applying a constant pressure to the lift tether as the platform is selectively lowered or raised. The roller 142 may further include an axle that is coupled to an end of the tension spring 140 that permits it to rotate freely about the axle as the lift tether 34 is wound or unwound from the lift drum 64. The pressure applied by the roller 142 ensures that the lift tether 34 winds evenly and uniformly onto the drum 62 without becoming tangled or kinked. It should be appreciated that each of the four lift drums would have a corresponding tensioner.

Figure 9:
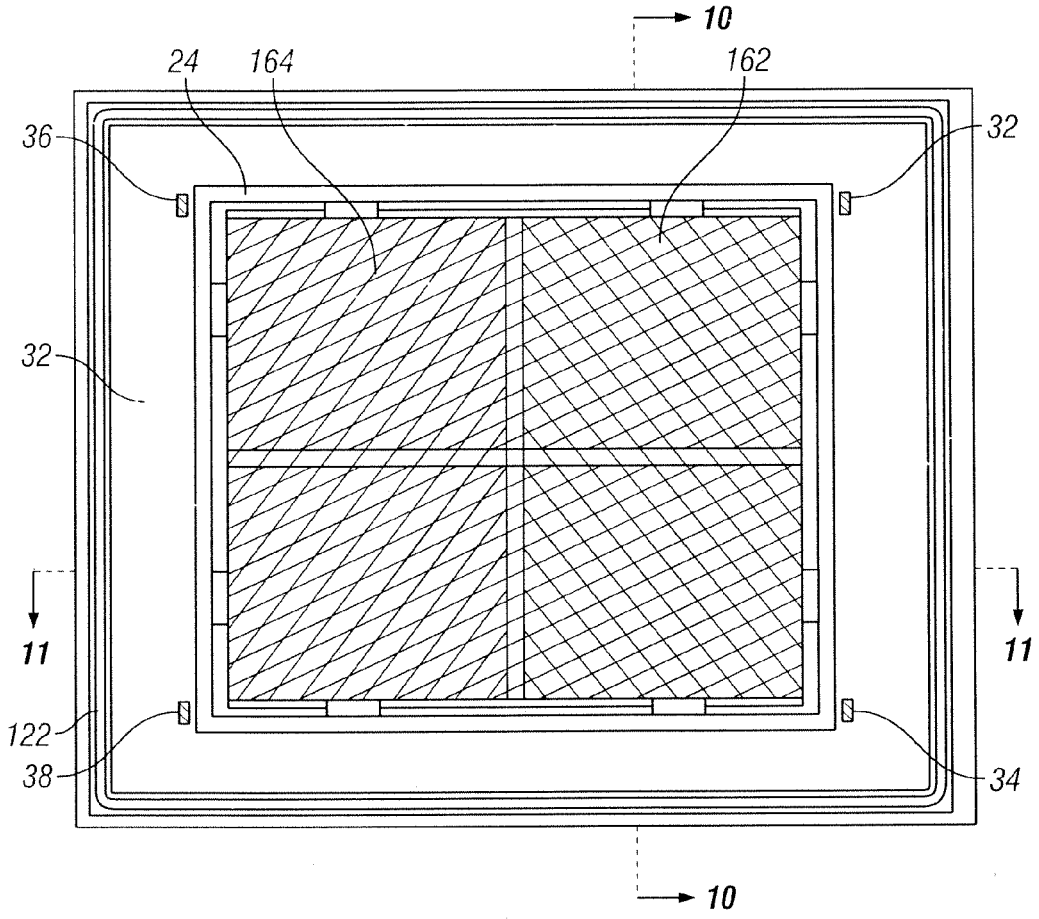
FIG. 9 is a top view of an embodiment of a platform including an integrated basket.
Figure 10:
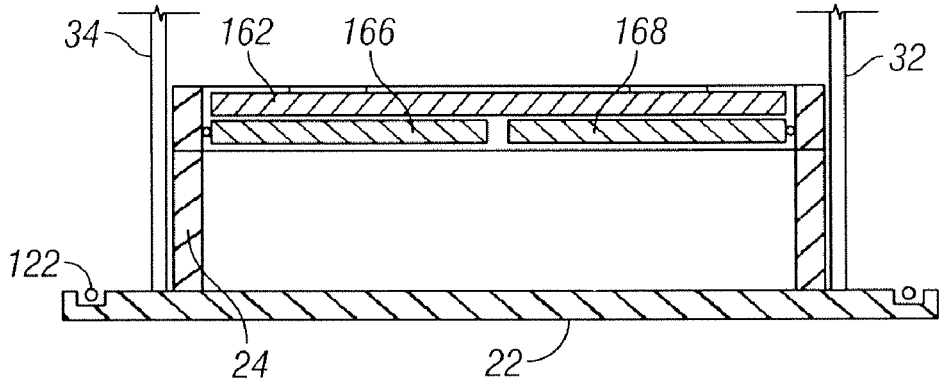
FIG. 10 is a sectional side view of the platform as taken through section 10-10 of FIG. 9.
Figure 11:
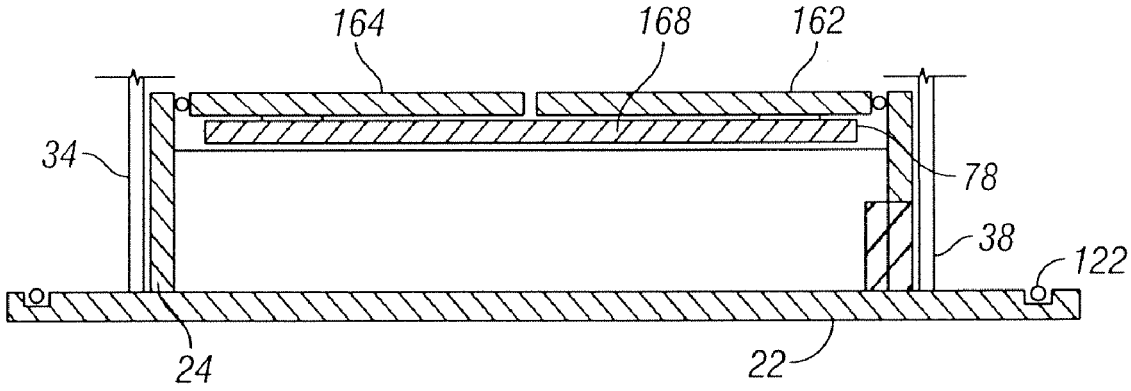
FIG. 11 is another sectional side view of the platform as taken through section 11-11 of FIG. 9.

FIGS. 9, 10 and 11 illustrate an embodiment of a platform that includes an integrated, collapsible basket. The platform further includes a plurality of folded fences 162, 164, 166, and 168. The fences 162, 164, 166, and 168 are each attached to the vertical wall 24 using hinges that permit them to pivot between horizontal and vertical positions. In the horizontal (or collapsed) position, fences 166 and 168 are nested below fences 162, 164. Each fence comprises a generally rectangular shape corresponding to roughly one-half of the area defined by the basket region. With the fences 162, 164, 166, and 168 disposed in the horizontal or collapsed configuration, a flat surface is defined onto which objects may be carried. Alternatively, with the fences 162, 164, 166, and 168 pivoted to the vertical (or deployed) position, a generally rectangular basket is formed into which objects may be placed. A latching mechanism may be included that attaches the fences 162, 164, 166, and 168 together when in the vertical position in order to maintain the basket. It should be appreciated that the basket may be advantageous for transporting small objects that might otherwise fall off the platform while it is being raised or lowered. The platform may also include a fixed position or fold-down ramp that facilitates loading of objects thereon.

Figure 12:
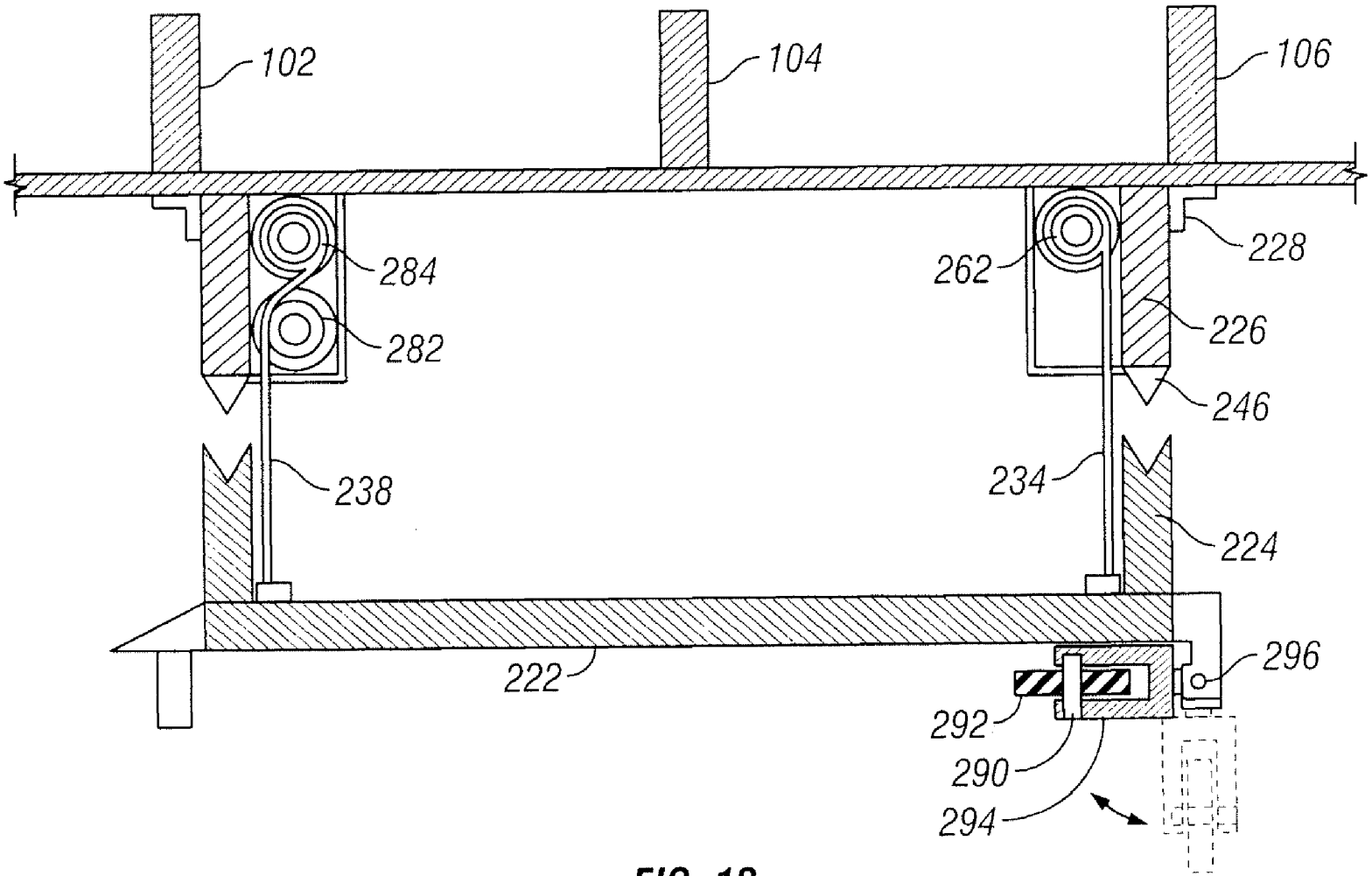
FIG. 12 is a side view of an alternative embodiment of a platform lift system that does not include a ceiling opening.

FIG. 12 illustrates a side view of an alternative embodiment of a platform lift system. Unlike the preceding embodiments in which the platform carried objects through a scuttle hole formed in an attic ceiling, the embodiment of FIG. 12 carries objects to a storage location disposed below the ceiling. This embodiment might be advantageous in a garage or loft in which there is a high ceiling but no attic space above the ceiling. Objects could be lifted up to this storage location, thereby clearing floor space below. The frame 226 of the platform lift system would be mounted to the ceiling, such as using angle brackets 228.

In the same manner as described above in the foregoing embodiments, lift tethers 234, 238 would carry a platform 222. Lift tethers 234, 238 would be wound onto lift drums 262, 284, respectively, which would be driven by a motor mechanism as described above. Extension idler 282 would serve to move the lift tether 238 outwardly as also described above. The platform 222 may have vertically extending alignment guides 224 that engage corresponding stops 246, which serve the purpose of defining the uppermost vertical extent of travel of the platform and guiding the platform into an aligned position.

FIG. 12 also illustrates a retractable wheel assembly affixed to a bottom surface of the platform 222. The wheel assembly includes a rotable wheel or caster 292 that rotates about an axle 290 carried by a housing 294. The wheel assembly is shown in a retracted (or horizontal) position. By pivoting the wheel assembly 90° about a pivot point 296, the wheel assembly can be moved to an operational position with the wheel 292 oriented vertically. The retractable wheel assembly enables the platform 222 to serve as a dolly for the purpose of moving objects around the floor, after disengaging the lift tethers 234, 238. It should be appreciated that all four corners of the platform 222 may include like retractable wheel assemblies. Additionally, the platform may further include a detachable and/or stowable handle to further facilitate use of the platform as a dolly. Moreover, the retractable wheel assembly of FIG. 12 could also be used with any of the foregoing embodiments of the invention.

Figure 13:
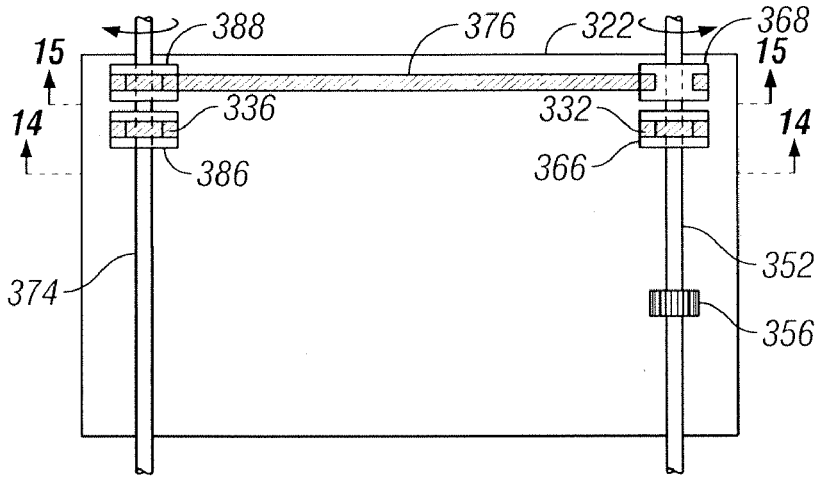
FIG. 13 is a top view of an alternative drive system for the platform lift system.
Figure 14:
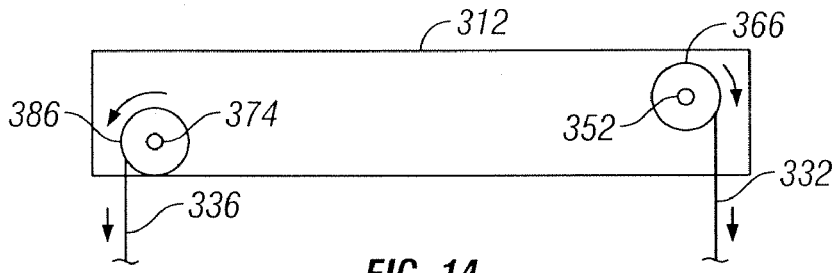
FIG. 14 is a side view of the alternative drive system as taken through the section 14-14 of FIG. 13.
Figure 15:
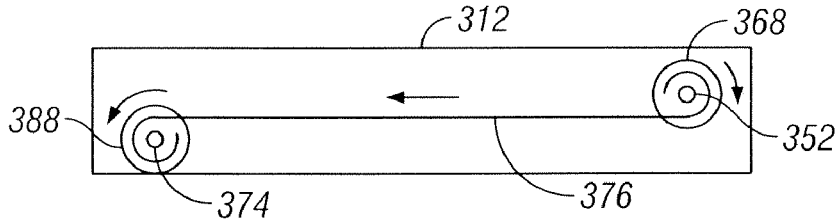
FIG. 15 is another side view of the alternative drive system as taken through the section 15-15 of FIG. 13.

FIGS. 13-15 illustrate an alternative embodiment of the drive system for the platform lift system. FIG. 13 shows a top view of a portion of the drive system having parallel shafts 352, 374 used to lift platform 322. FIG. 14 shows a side sectional view of the drive system and frame 312 as taken through the section 14-14 of FIG. 13, and FIG. 15 shows a side sectional view of the drive system and frame 312 as taken through the section 15-15 of FIG. 13. As in the previous embodiments, shafts 352 and 374 carry respective lift drums 366, 386, which in turn have lift tethers 332, 336 wound thereon. Drive gear 356 carried by shaft 352 is driven by a suitable drive mechanism (not shown).

Instead of using a continuous loop to drive the two main shafts 352, 374 to rotation, a non-continuous spooling drive belt 376 has a first end fixedly attached to the first belt drive pulley 368 and a second end fixedly attached to the second belt drive pulley 388. The spooling drive belt 376 is wound onto the belt drive pulleys 368, 388, such that when the platform is fully raised the drive belt is completely wound onto the first belt drive pulley 368 and when the platform is fully lowered the drive belt is completely wound onto the second belt drive pulley 388. By fixedly attaching the ends of the spooling drive belt 376 to the belt drive pulleys 368, 388, the drive belt provides a limit to the amount of vertical travel of the platform. Also, the shaft 374 is offset vertically with respect to shaft 352 (see FIG. 14), and the drive belt 376 is wound onto the belt drive pulleys in opposite directions. Thus, the first belt drive pulley 368 rotates counterclockwise while the second belt drive pulley 388 rotates clockwise, and vice versa (see FIG. 15). This arrangement has the advantage of paying out the lift tethers from the outer periphery of the pulleys, thereby eliminating the need for separate extension idlers to manipulate the lift tether 336 to the peripheral region. It should be appreciated that the drive system will also include lift drums and drive pulleys at the other ends of shafts 352, 374, but these are omitted from FIG. 13 to simplify the drawing.

Figure 16:
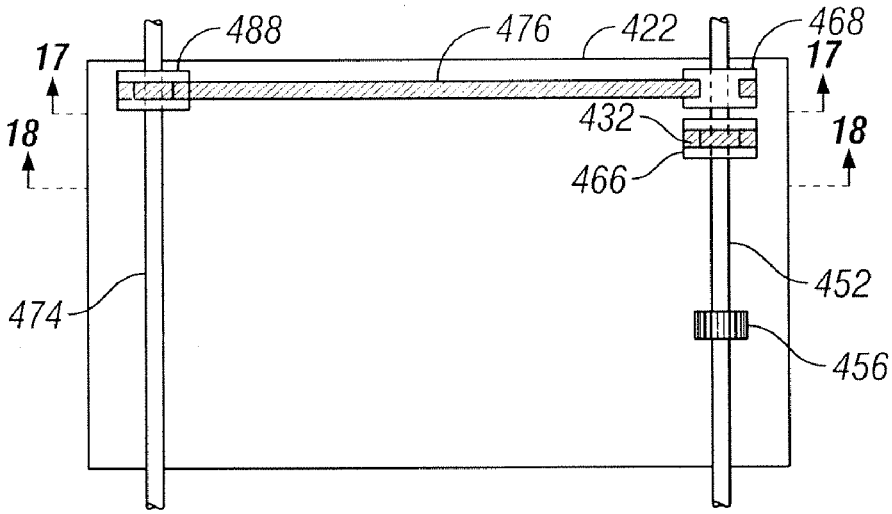
FIG. 16 is a top view of another alternative drive system for the platform lift system.
Figure 17:
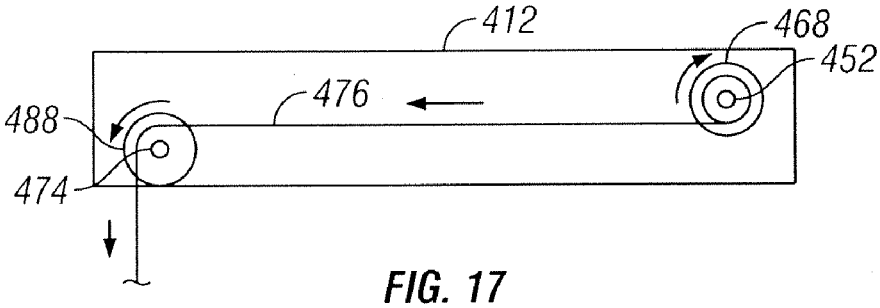
FIG. 17 is a side view of the alternative drive system as taken through the section 17-17 of FIG. 16.
Figure 18:
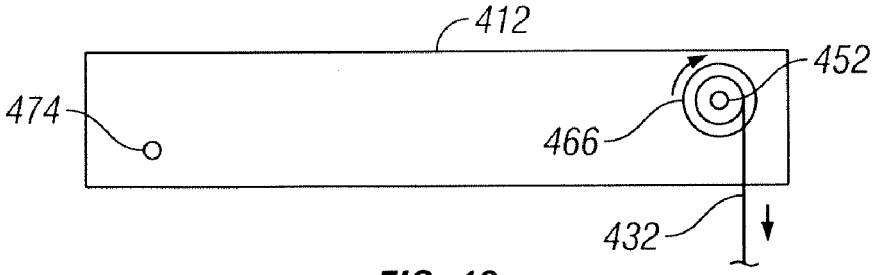
FIG. 18 is another side view of the alternative drive system as taken through the section 18-18 of FIG. 16.

FIGS. 16-18 illustrate another alternative embodiment of the drive system for the platform lift system. FIG. 16 shows a top view of a portion of the drive system having parallel shafts 452, 474 used to lift platform 422. FIG. 17 shows a side sectional view of the drive system and frame 412 as taken through the section 17-17 of FIG. 16, and FIG. 18 shows a side sectional view of the drive system and frame 412 as taken through the section 18-18 of FIG. 16. Shaft 452 carries lift drum 466, which in turn has lift tether 432 coupled thereto. Drive gear 456 carried by shaft 452 is driven by a suitable drive mechanism (not shown).

In this embodiment, the separate functions of the lift drums and drive pulleys are combined and the drive belt 476 provides both driving and lifting. Particularly, the drive belt 476 has a first end fixedly attached to spooling belt drive pulley 468 and a second end that is carried partly by the idler lift drum 488 and then extends vertically to provide a lift tether. When the platform 422 is fully raised, the drive belt 476 is wound onto the belt drive pulley 468 and when the platform is fully lowered the drive belt is completely paid out. As in the preceding embodiment, the shaft 474 is offset vertically with respect to shaft 452, and the drive belt 476 causes the belt drive pulley 468 and the idler lift drum 488 to rotate in opposite directions. Thus, the idler lift drum 488 rotates counterclockwise while the belt drive pulley 468 rotates clockwise, and vice versa (see FIG. 17). Clockwise rotation of lift drum 466 (as seen in FIGS. 17 and 18) in unison with belt drive pulley 468 pays out lift tether 432. This arrangement has the advantage of reducing the number of pulleys and associated belts. It should be appreciated that the drive system will also include idler lift drums and belt drive pulleys at the other ends of shafts 452, 474, but these are omitted from FIG. 16 to simplify the drawing.

Figure 19:
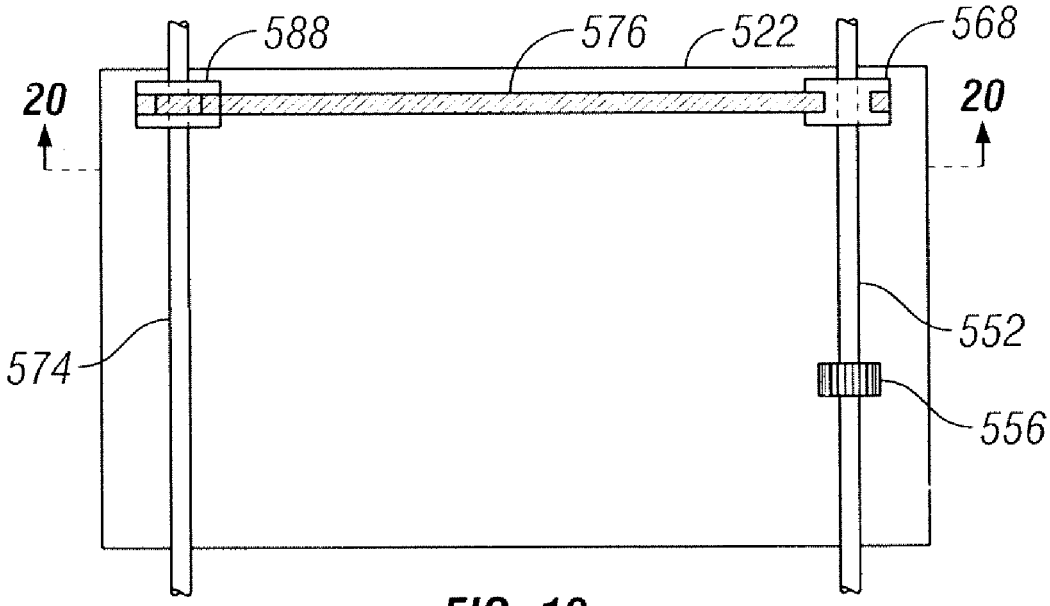
FIG. 19 is a top view of yet another alternative drive system for the platform lift system.
Figure 20:
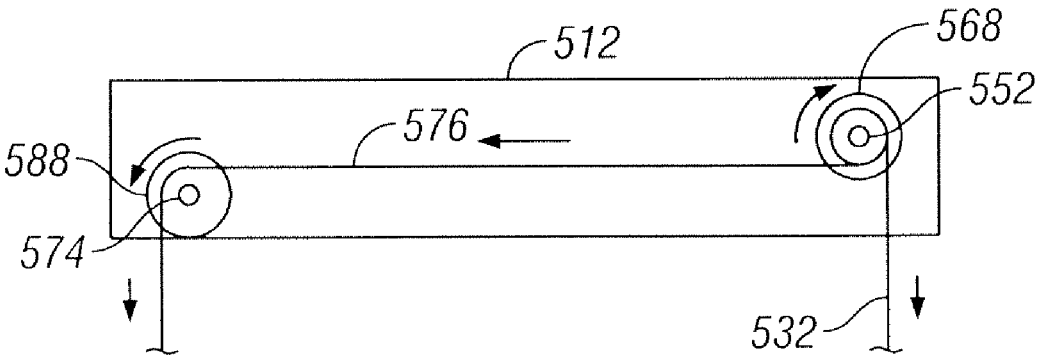
FIG. 20 is a side view of the alternative drive system as taken through the section 20-20 of FIG. 19.

FIGS. 19-20 illustrate another alternative embodiment of the drive system for the platform lift system. FIG. 19 shows a top view of a portion of the drive system having parallel shafts 552, 574 used to lift platform 522. FIG. 20 shows a side sectional view of the drive system and frame 512 as taken through the section 20-20 of FIG. 19. Drive gear 556 carried by shaft 552 is driven by a suitable drive mechanism (not shown).

In this embodiment, the functions of the lift drums and belt drive pulleys are combined and the belt 576 provides both driving and lifting. Particularly, the belt 576 has a first end fixedly attached to the belt drive pulley 568 and a second end that is carried partly by the idler lift drum 588 and then extends vertically to provide a lift tether. The belt drive pulley 568 also includes a separate lift tether 532 that is wound onto the drive pulley along with the drive belt 576 (see FIG. 20). When the platform 522 is fully raised, the drive belt 576 and lift tether 532 are wound onto the belt drive pulley 568 and when the platform is fully lowered the drive belt 576 and lift tether 532 are completely paid out. As in the preceding embodiment, the shaft 574 is offset vertically with respect to shaft 552, and the drive belt 576 causes the belt drive pulley 568 and idler lift drum 588 to rotate in opposite directions (see FIG. 20). It should be appreciated that the drive system will also include another belt drive pulley at the other end of shaft 552 and another idler lift drum at the other end of shaft 574, but these are omitted from FIG. 19 to simplify the drawing.

Figure 21:
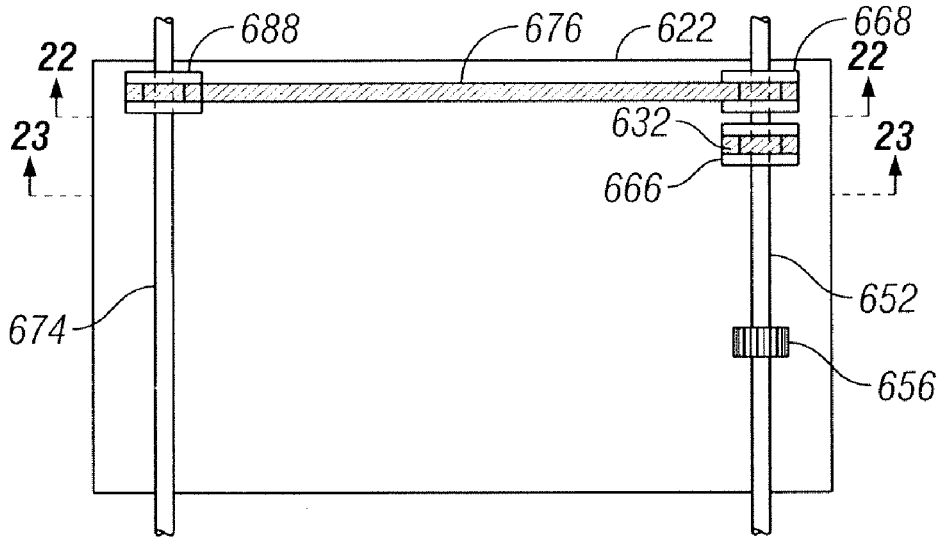
FIG. 21 is a top view of another alternative drive system for the platform lift system.
Figure 22:
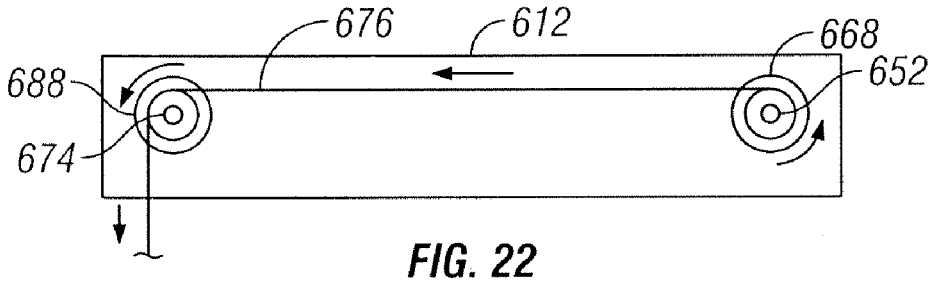
FIG. 22 is a side view of the alternative drive system as taken through the section 22-22 of FIG. 21.
Figure 23:
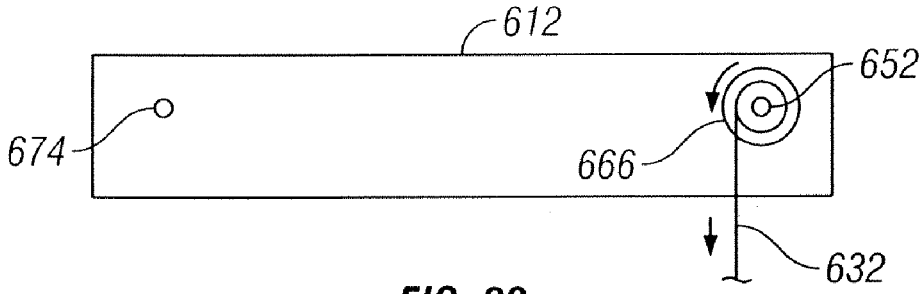
FIG. 23 is another side view of the alternative drive system as taken through the section 23-23 of FIG. 21.

FIGS. 21-23 illustrate another alternative embodiment of the drive system for the platform lift system. FIG. 21 shows a top view of a portion of the drive system having parallel shafts 652, 674 used to lift platform 622. FIG. 22 shows a side sectional view of the drive system and frame 612 as taken through the section 22-22 of FIG. 21, and FIG. 23 shows a side sectional view of the drive system and frame 612 as taken through the section 23-23 of FIG. 21. Shaft 652 carries lift drum 666, which in turn has lift tether 632 coupled thereto. Drive gear 656 carried by shaft 652 is driven by a suitable drive mechanism (not shown).

As in the preceding embodiments, the separate functions of the lift drums and drive pulleys are combined and the drive belt 676 provides both driving and lifting. Particularly, the drive belt 676 has a first end fixedly attached to spooling belt drive pulley 668 and a second end that is carried partly by the idler lift drum 688 and then extends vertically to provide a lift tether. Unlike the preceding embodiments, the drive belt 676 is paid out from the top of belt drive pulley 668, rather than from the bottom. This way, the shaft 674 is aligned vertically with respect to shaft 652 instead of offset. When the platform 622 is fully raised, the drive belt 676 is wound onto the belt drive pulley 668 and when the platform is fully lowered the drive belt is completely paid out. The drive belt 676 causes the belt drive pulley 668 and the idler lift drum 688 to rotate in the same direction. Counterclockwise rotation of lift drum 666 (as seen in FIGS. 22 and 23) in unison with belt drive pulley 668 pays out lift tether 632. This arrangement has the advantage of reducing the number of pulleys and associated belts. It should be appreciated that the drive system will also include another lift drum and belt drive pulley at the other end of shaft 652, and another idler lift drum at the other end of shaft 674, but these are omitted from FIG. 21 to simplify the drawing.

Figure 24:
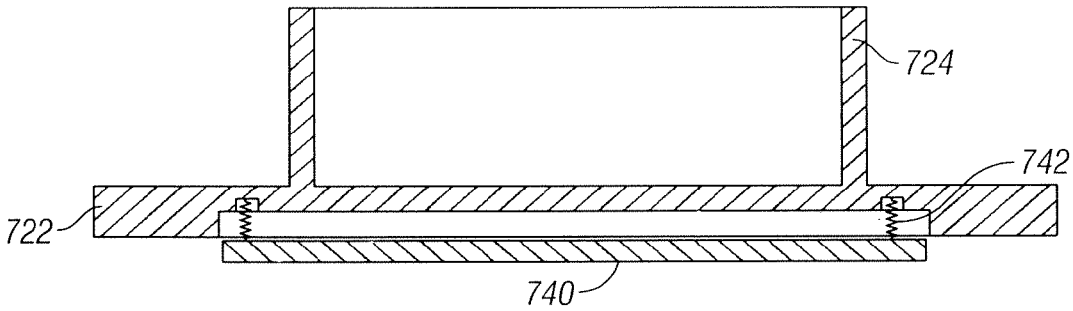
FIG. 24 is a side view of an embodiment of the platform lift system having an impact detection system.
Figure 25:
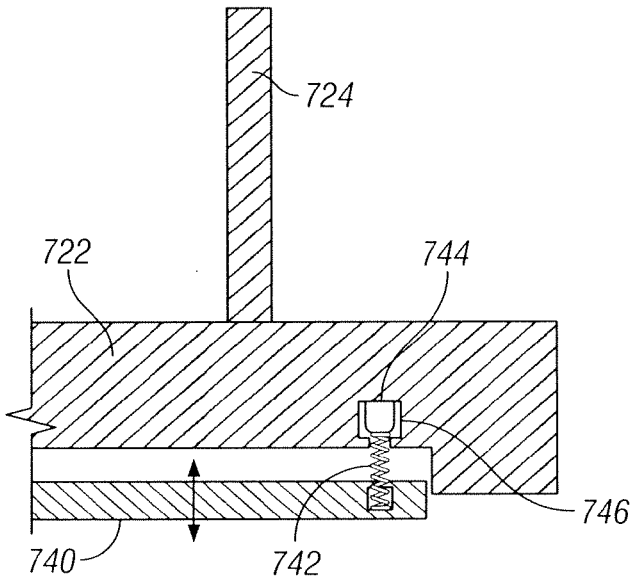
FIG. 25 is an enlarged side view of a portion of the impact detection system of FIG. 24.

FIGS. 24-25 illustrate a side view of an alternative embodiment of the lift platform having an impact detection system. The lift platform includes base 722 and walls 724 substantially similar to the lift platform of the preceding embodiments. A contact plate 740 is coupled to the underside of the platform base 722 using a plurality of compression springs 742. Particularly, the platform base may further include a plurality of recesses 746 within which the compression springs 742 are seated along with an associated microswitch 744. The arrangement permits the contact plate 740 to be movable against the bias applied by the compression springs 742. One or more of the microswitches 744 disposed within the recesses 746 close when the contact plate 740 is caused to move and compress one or more of the associated compression springs 742. Accordingly, if the platform base 722 comes into contact with an object as the lift platform is descending, causing the contact plate 740 to move against the spring bias, an electrical signal formed by at least one of the closed microswitch contacts can trigger a halt to the movement of the lift platform. Conventional proximity sensors could also be used instead of microswitches to detect the proximity of the plate to an object.

The electrical signal may be communicated to the motor control circuitry in any number of known ways. In one example, the electrical signal is communicated to the motor control circuitry over a wire conductor embedded within one or more of the lift tethers and terminated on slip rings mounted to one or more of the lift drums. In another example, the electrical signal is communicated using known optical or RF communication techniques between the platform and the motor control circuitry. In either embodiment, the control circuitry would halt the motor when any of the microswitches are closed or proximity sensors triggered.

While it is considered that additional horizontal stabilization is not necessary for the present invention in most applications, it should be appreciated by persons having ordinary skill in the art that a wide variety of such devices could be used to control and/or stabilize the horizontal travel of the platform during lifting operations if needed. Examples of such devices include scissor or accordion-type mechanisms terminated at the platform and/or frame to control motion in one or more axes of horizontal translational or rotational travel.

Having thus described a preferred embodiment of a platform lift system, it should be apparent to those skilled in the art that certain advantages have been achieved. It should also be appreciated that various modifications, adaptations, and alternative embodiments thereof may be made within the scope and spirit of the present invention.

What is claimed is:

1. A platform lift apparatus, comprising:

a rectangular main body having external vertical mounting surfaces defining an outer periphery thereof, the main body having an open region that extends entirely vertically through the main body and is located inward laterally from the external vertical mounting surfaces, the main body remaining in a fixed position during operation of the apparatus;

a drive mechanism disposed entirely within the main body and adjacent to the open region, the drive mechanism including a motor and at least one rotatable shaft driven by the motor, the shaft having a plurality of lift drums coupled thereto;

a plurality of lift cables with each one being coupled at a first end thereof to a respective one of the plurality of lift drums, the plurality of lift cables being adapted to be wound onto respective ones of the plurality of lift drums and payed out from respective ones of the plurality of lift drums by selective operation of the drive mechanism;

a lift platform coupled to second ends of each of said lift cables, the lift platform being thereby suspended by the lift cables, the lift platform being vertically movable by selective operation of the drive mechanism between a stowed position and a deployed position, the lift platform having a shape permitting nesting within the open region of the main body; and a plurality of pulleys oriented within the main body in substantial horizontal alignment with corresponding ones of the lift drums, the plurality of pulleys being in engagement with respective ones of the plurality of lift cables intermediate the plurality of lift drums and the lift platform;

wherein when the lift platform is in the stowed position, the lift platform substantially nests within the open region of the main body adjacent the drive mechanism to permit loading and unloading of the lift platform from above the main body, and when the lift platform is in said deployed position, the lift platform is deployed vertically below the main body by a distance determined by the selective paying out of the plurality of lift cables.

2. The platform lift apparatus of claim 1, wherein the lift platform further comprises a horizontal base and a plurality of vertical walls defining a basket.

3. The platform lift apparatus of claim 1, wherein a first pair of the plurality of lift drums is disposed at a first end of the shaft and a second pair of the plurality of lift drums is disposed at a second end of the shaft.

4. The platform lift apparatus of claim 1, wherein the platform has a rectangular shape and the plurality of lift cables further comprise four lift cables that are coupled to respective corners of the platform.

5. The platform lift apparatus of claim 4, wherein the plurality of pulleys further comprise four pulleys arranged around the periphery of the open region and being respectively aligned vertically with corresponding corners of the platform.

* * * * *